US010414617B2

(12) United States Patent
Yu Chen

(10) Patent No.: US 10,414,617 B2
(45) Date of Patent: Sep. 17, 2019

(54) UPRIGHT CUTTER FOR PACKING MATERIALS

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 15/473,642

(22) Filed: Mar. 30, 2017

(65) Prior Publication Data

US 2018/0282102 A1 Oct. 4, 2018

(51) Int. Cl.

| | |
|---|---|
| ***B26D 7/26*** | (2006.01) |
| ***B65H 35/00*** | (2006.01) |
| ***B26D 1/06*** | (2006.01) |
| ***B26D 7/27*** | (2006.01) |
| ***B26D 7/00*** | (2006.01) |

(52) U.S. Cl.

CPC ..... *B65H 35/0086* (2013.01); *B26D 1/065* (2013.01); *B26D 7/0006* (2013.01); *B26D 7/2628* (2013.01); *B26D 7/27* (2013.01); *B65H 2301/4132* (2013.01); *B65H 2301/51512* (2013.01); *B65H 2701/1944* (2013.01)

(58) Field of Classification Search

CPC .. B65H 35/0086; B26D 1/065; B26D 7/2628; B26D 7/27

See application file for complete search history.

(56) References Cited

U.S. PATENT DOCUMENTS

| | | | | |
|---|---|---|---|---|
| 1,609,093 A * | 11/1926 | Miller | B26D 1/0006 | 30/294 |
| 2,753,938 A * | 7/1956 | Thiess | B65H 35/0006 | 83/455 |
| 4,197,774 A * | 4/1980 | Singh | B26D 1/045 | 83/374 |
| 7,726,222 B2 * | 6/2010 | Endresen | B26D 1/025 | 83/408 |

* cited by examiner

*Primary Examiner* — Kenneth E Peterson
*Assistant Examiner* — Liang Dong
(74) *Attorney, Agent, or Firm* — Bruce Stone LLP; Joseph Bruce

(57) ABSTRACT

An upright cutter for packing materials includes a base, a support device, and a cutting device. The base includes an upright post. The support device has a shaft. The shaft is vertically fixed to the upright post. The cutting device includes a pole. The pole is pivotally connected to the upright post. The pole is connected with a transverse rod. The transverse rod is parallel to the shaft. The transverse rod is provided with a cutting member which is movable axially along the transversely rod. Two sides of the cutting member are provided with blades, respectively. The pole can be pivoted, so that the transverse rod is adjusted to the most appropriate position. By using the blades at the two sides of the cutting member, the cutting member can be moved back and forth on the transverse rod for cutting to improve the cutting efficiency.

9 Claims, 7 Drawing Sheets

UPRIGHT CUTTER FOR PACKING MATERIALS

FIELD OF THE INVENTION

The present invention relates to a cutter for packing materials, and more particularly to an upright cutter for packing materials.

BACKGROUND OF THE INVENTION

In general, packaging materials, such as bubble wrap, film and the like, are rolled to form a packing material roll in order to facilitate storage and transportation. A conventional cutter for packaging material mainly comprises a base. The base is pivotally connected with a shaft and a frame in parallel. The frame is slidably provided with a cutting member. When in use, a packing material roll is first mounted on the shaft, and the packaging material is pulled out of the roll to pass through the frame, and then the cutting member is slid for cutting the packing material.

However, the conventional cutter has some shortcomings. Because the cutting member is operated for only one-way cutting, it must be homed to the original position after cutting in order to perform next cutting. The cutting efficiency is low. The volume of the packing material roll will decrease with the times of use, but the positions of the shaft, the frame and the cutting member are immovable. The cutting angle cannot be properly adjusted, so it is very inconvenient for use. Accordingly, the inventor of the present invention has devoted himself based on his many years of practical experiences to solve these problems.

SUMMARY OF THE INVENTION

The primary object of the present invention is to provide an upright cutter for packing materials. The cutting angle of the upright cutter is adjustable, and a cutting member of the upright cutter can be operated in a bidirectional manner to improve the cutting efficiency.

In order to achieve the aforesaid object, the upright cutter of the present invention comprises a base, a support device, and a cutting device. The base includes an upright post. The support device has a shaft. The shaft is vertically fixed to the upright post. The cutting device includes a pole. The pole is pivotally connected to the upright post. The pole is connected with a transverse rod. The transverse rod is parallel to the shaft. The transverse rod is provided with a cutting member which is movable axially along the transversely rod. Two sides of the cutting member are provided with blades, respectively.

The pole of the upright cutter of the present invention can be pivoted, so that the transverse rod is adjusted to the most appropriate position. By using the blades at the two sides of the cutting member, the cutting member can be moved back and forth on the transverse rod for cutting to improve the cutting efficiency.

DETAILED DESCRIPTION OF THE PREFERRED EMBODIMENTS

Embodiments of the present invention will now be described, by way of example only, with reference to the accompanying drawings.

Figure 1:
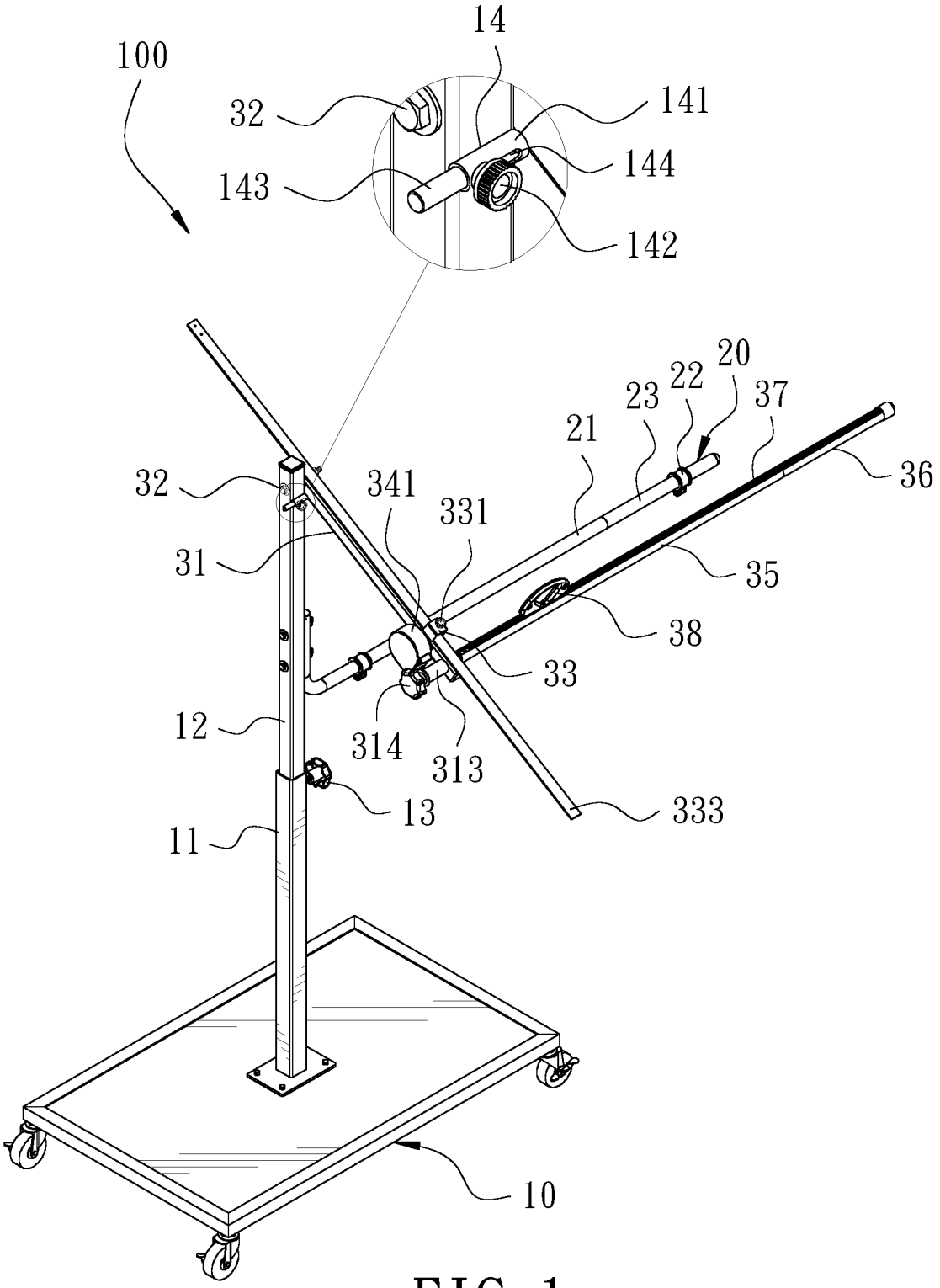
FIG. 1 is a perspective view of an upright cutter for packing materials of the present invention.
Figure 2:
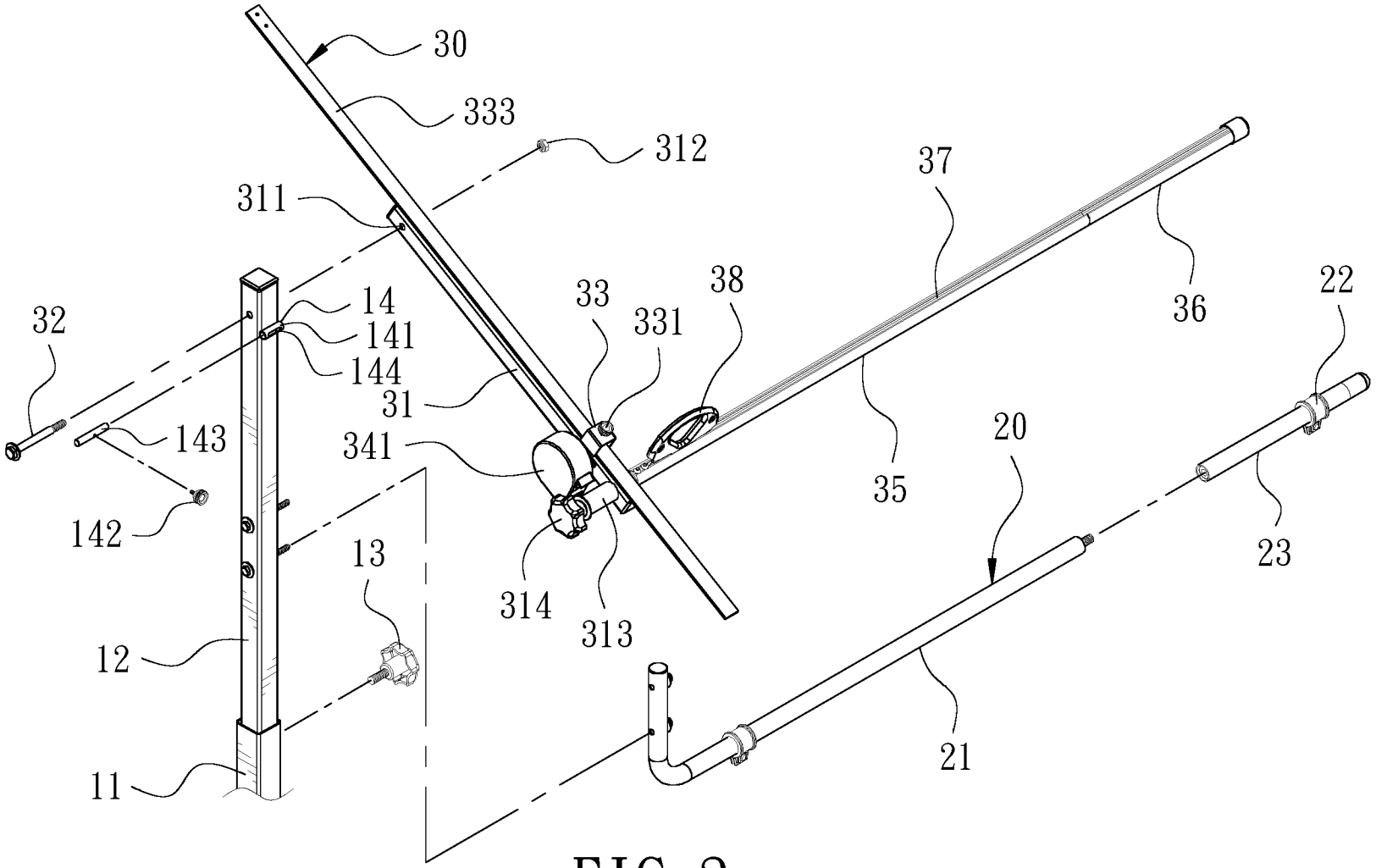
FIG. 2 is a partial exploded view of the upright cutter for packing materials of the present invention.
Figure 3:
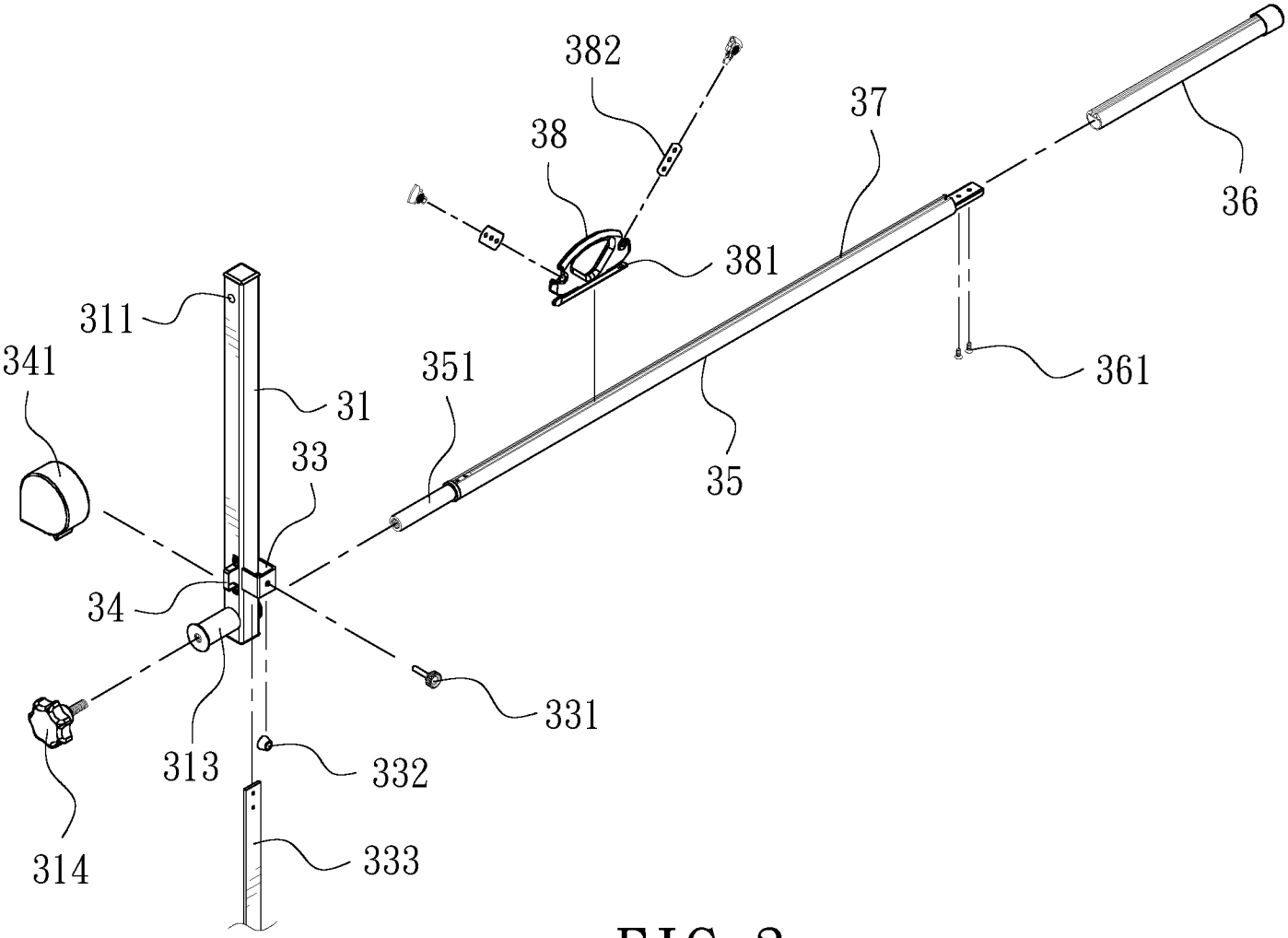
FIG. 3 is an exploded view of a cutting device of the present invention.

FIG. 1 is a perspective view of an upright cutter for packing materials of the present invention. FIG. 2 is a partial exploded view of the upright cutter for packing materials of the present invention. FIG. 3 is an exploded view of a cutting device of the present invention. The present invention discloses an upright cutter 100 for packing materials. The upright cutter 100 comprises a base 10, a support device 20, and a cutting device 30.

The base 10 includes an upright post 11. The upright post 11 has an extension section 12. The extension section 12 is screwed to the upright post 11 with a screw member 13. The screw member 13 is a hand knob screw. The upright post 11 is provided a limit member 14. The limit member 14 has an accommodation portion 141, a switch knob 142, and a latch 143. The accommodation portion 141 is a hollow cylinder. A side wall of the accommodation portion 141 is formed with an opening 144. The latch 143 is disposed in the accommodation portion 141. The switch knob 142 is a hand knob screw with a threaded section passing through the opening 144 and screwed to the latch 143, such that the latch 143 can be displaced along the accommodation portion 141 to from a first position and a second position.

The support device 20 has a shaft 21. The shaft 21 is vertically fixed to the upright post 11. The shaft 21 is sleeved with two tightening tubes 22. The shaft 21 is threadedly connected with a first extension portion 23.

Figure 4:
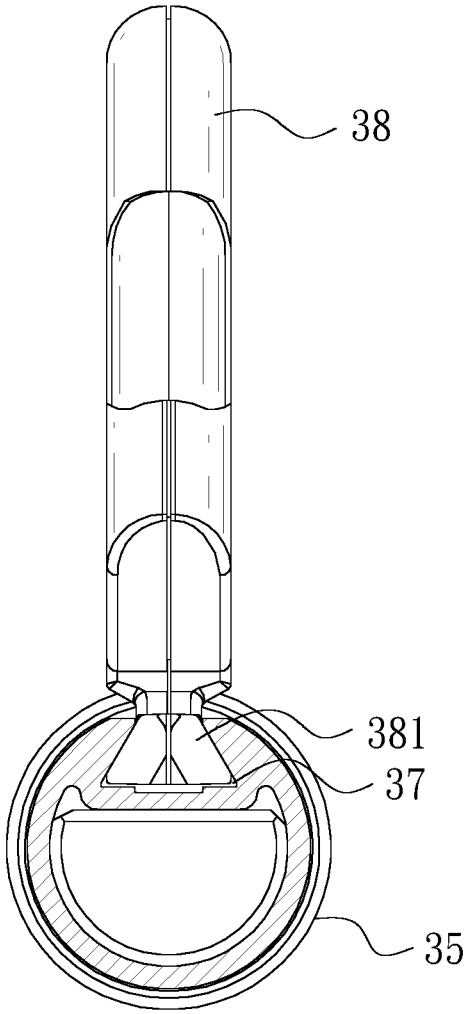
FIG. 4 is a sectional view of the cutting device of the present invention.

The cutting device 30 includes a pole 31. The pole 31 is provided with a pivot member 32. The pivot member 32 is a half thread screw. One end of the pivot member 32 is fixed to the upright post 11. Another end of the pivot member 32 is inserted through a pivot hole 311 of the pole 31 and fixed by a nut 312. The pole 31 is provided with a fixing seat 33. The fixing seat 33 is provided with a positioning member 331. The positioning member 331 is a knob. The positioning member 331 is connected with a positioning block 332. The positioning block 332 is configured to clamp a measuring scale 333. The pole 31 is provided with a hook 34 for hanging a tape measure 341. The pole 31 is provided with a hollow sleeve 313. The sleeve 313 is connected with a transverse rod 35. The transverse rod 35 is parallel to the shaft 21. The length of the transverse rod 35 is greater than the length of the shaft 21. The pole 31 is provided with a fixing member 314 for fixing the transverse rod 35. The fixing member 314 is a knob. In an embodiment, one end of the transverse rod 35 is provided with a connecting rod 351. The connecting rod 351 is connected to the sleeve 313. The fixing member 314 is inserted through the sleeve 313 and screwed to the connecting rod 351. The transverse rod 35 is provided with a second extension portion 36 corresponding to the first extension portion 23. The second extension portion 36 is secured to the transverse rod 35 with a plurality of screws 361. Each of the transverse rod 35 and the second extension portion 36 is axially formed with a dovetail groove 37. The transverse rod 35 is provided with a cutting member 38. Referring to FIG. 4, the cutting member 38 is provided with a dovetail block 381 corresponding to the dovetail groove 37. The dovetail block 381 is fitted in the dovetail groove 37, so that the cutting member 38 is slidable in the dovetail groove 37. Two sides of the cutting member 38 are provided with blades 382, respectively. The blades 382 are replaceable circular blades or rhombic blades. In this embodiment, the blades 382 are rhombic blades.

Figure 5:
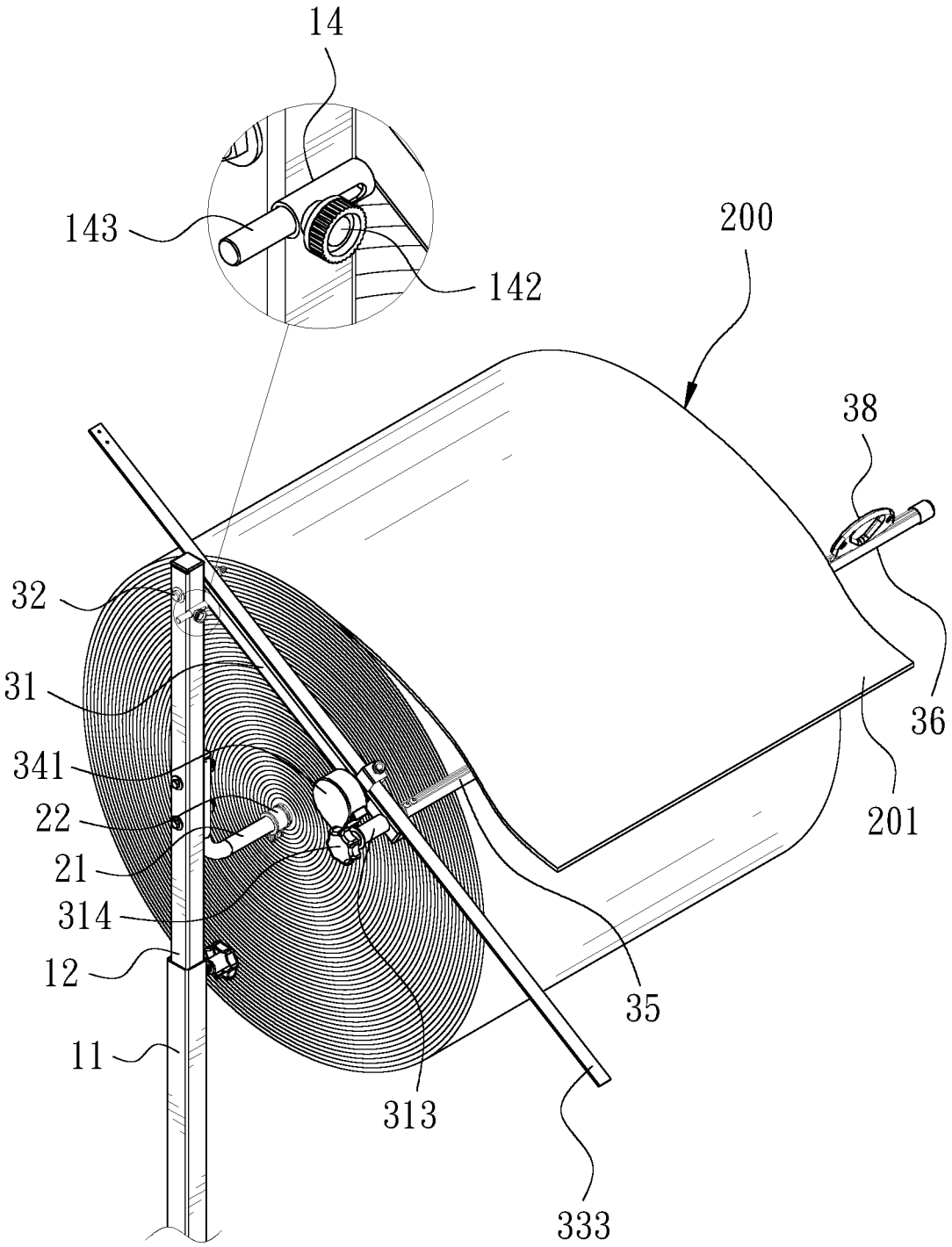
FIG. 5 is a schematic view of the present invention when in use.

Referring to FIG. 5, a packing material roll 200 is fitted on the shaft 21, and then the two tightening tubes 22 are used to clamp the packing material roll 200, so that the packing material roll 200 is secured on the shaft 21. A section of the packing material 201 is pulled out of the packing material roll 200 and placed on the transverse rod 35. The length of the packaging material 201 for necessary can be measured by the measuring scale 333 or the tape measure 341 provide on the pole 31. Afterward, the packing material 201 is cut along the axial direction of the transverse rod 35 by the cutting member 38.

Referring to FIG. 3, the two sides of the cutting member 38 are provided with the blades 382 respectively, and the length of the transverse rod 35 is greater than the length of the shaft 21. The cutting member 38 can be at either of both ends of the transverse rod 35. The packing material 201 is placed flat on the transverse rod 35, and the cutting member 38 can be moved back and forth on the transverse rod 35 for cutting in a bi-directional manner, not limited to a unidirectional manner, to improve the cutting efficiency. Furthermore, the dovetail block 381 is fitted in the dovetail groove 37 to enhance the smoothness of the cutting member 38.

Figure 6:
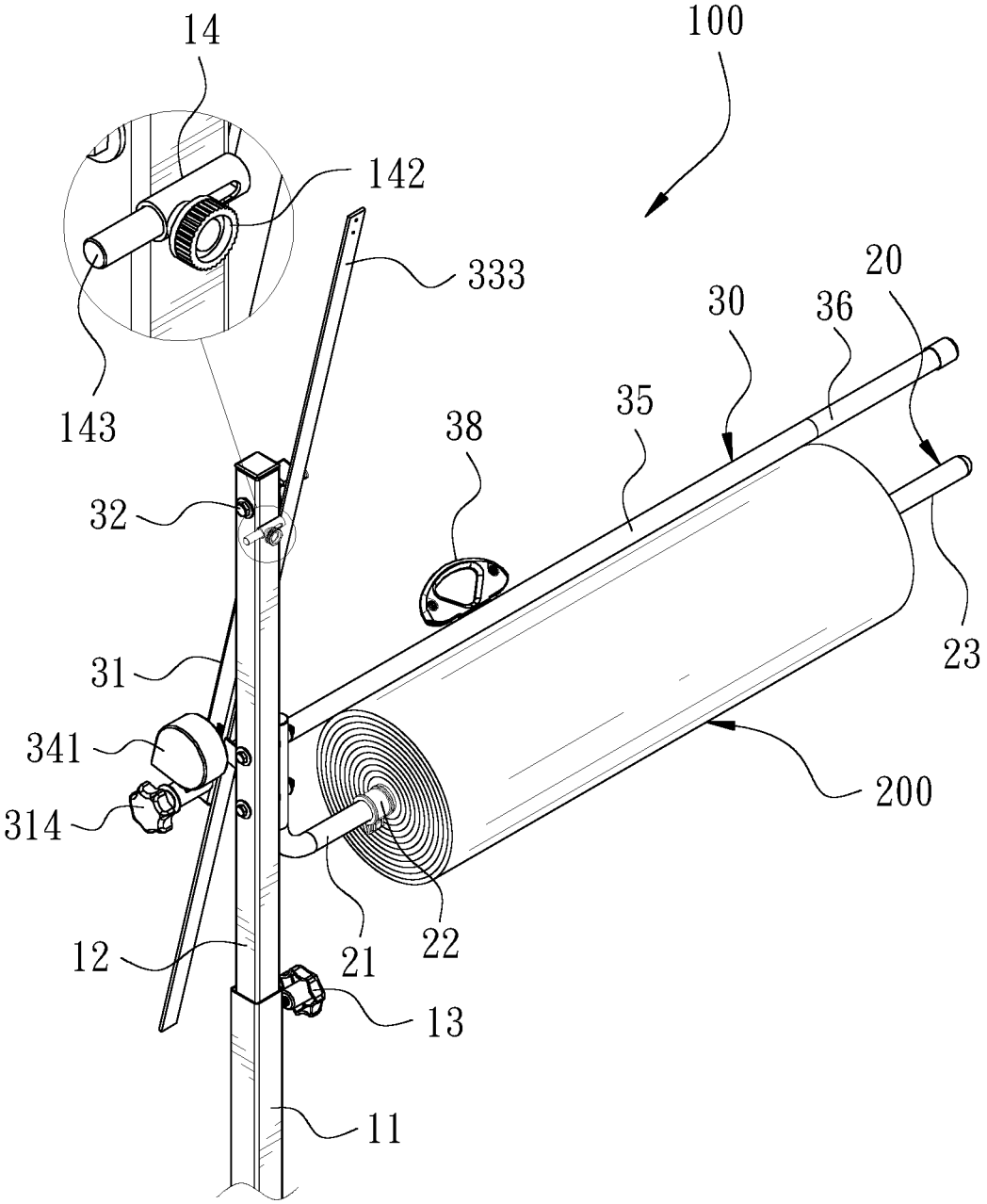
FIG. 6 is a schematic view of the present invention when in use, showing that the cutting device is located at another side of a support device.

Referring to FIG. 6, when the volume of the packing material roll 200 decreases, the user can adjust the latch 143 to the first position. Thereby, according to the desired cutting angle, the pole 31 can be pivoted by the user to bring the transverse rod 35 to the other side of the support device 20, and the fixing member 314 is loosened for turning the transverse rod 35 so as to adjust the angle of the cutting member 38. After adjustment, the fixing member 314 is locked tightly so that the cutting member 38 is at an optimum position for operation.

Figure 7:
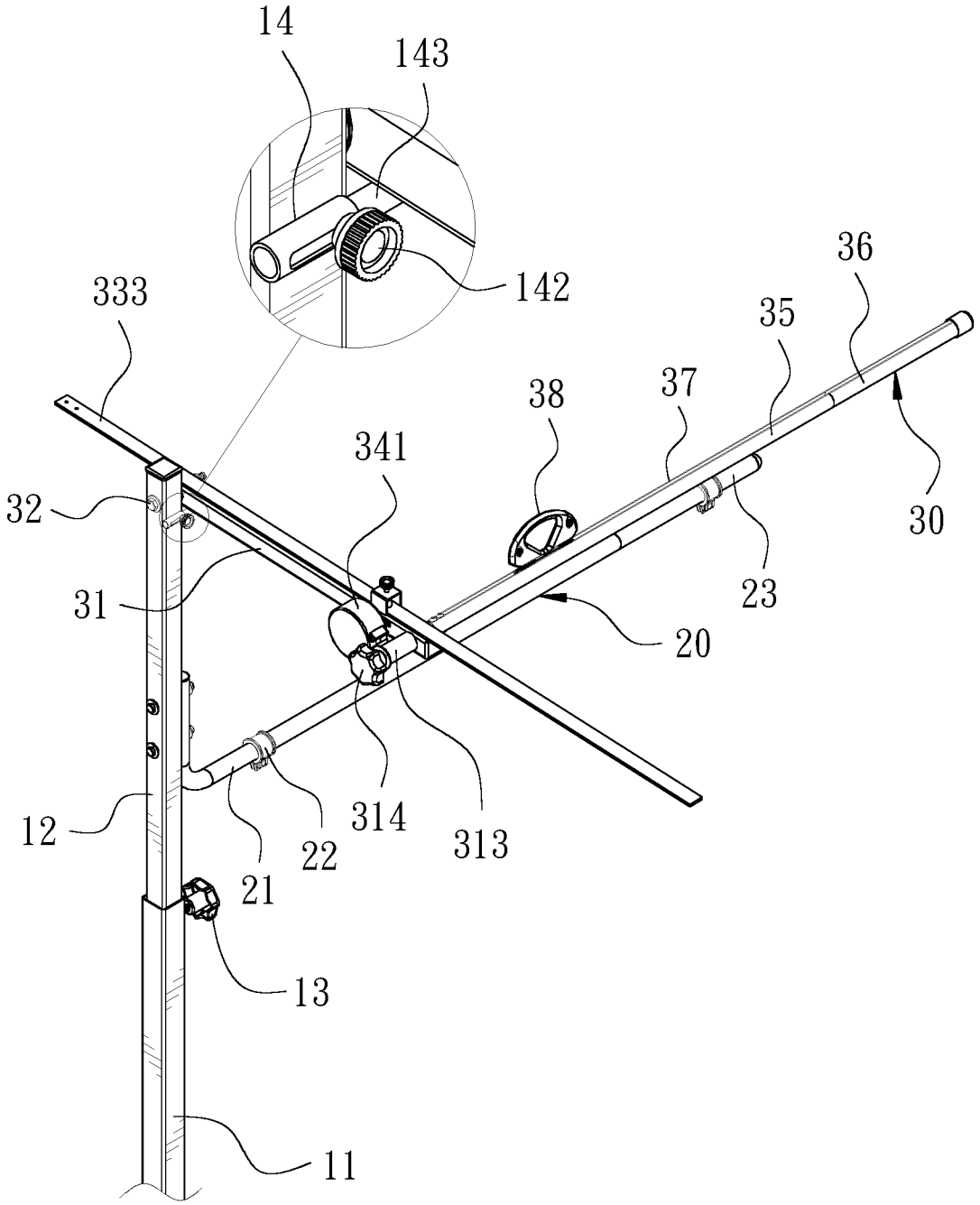
FIG. 7 is a schematic view of the present invention when in use, showing the pole in a fixed state.

Referring to FIG. 7, when the user wants to replace the packing material roll 200, the latch 143 is adjusted to the second position by the user so that the pole 31 leans against the latch 143. After that, another packing material roll 200 is fitted on the shaft 21, and then the latch 143 is adjusted to the first position again for cutting. Thereby, the replacement of the packing material roll 200 can be performed by one person alone.

It is worth mentioning that the size of the packing material roll 200 may be different. If the length of the packing material roll 200 is too long, the shaft 21 is connected with the first extension portion 23 and the transverse rod 35 is connected with the second extension portion 36, so that the packing material roll 200 can be fitted on the shaft 21 to meet the needs of the user.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An upright cutter for packing materials, comprising: a base, including an upright post;

a support device, having a shaft, the shaft being vertically fixed to the upright post;

a cutting device, including a pole, the pole being pivotally connected to the upright post, the pole being connected with a transverse rod that extends transversely to the pole, the transverse rod being parallel to the shaft, the transverse rod being provided with a cutting member which is movable axially along the transverse rod, two sides of the cutting member being provided with blades, respectively, wherein the pole is provided with a hollow sleeve, the sleeve is connected with the transverse rod, and the pole is provided with a fixing member for fixing the transverse rod, where said fixing member can be adjusted to change a rotational angle of the transverse rod and cutting member, said rotational angle being adjusted about a longitudinal axis of the transverse rod.

2. The upright cutter for packing materials as claimed in claim 1, wherein the transverse rod is axially formed with a dovetail groove, the cutting member is provided with a dovetail block corresponding to the dovetail groove, and the dovetail block is fitted in the dovetail groove.

3. The upright cutter for packing materials as claimed in claim 1, wherein the blades are replaceable circular blades or rhombic blades.

4. The upright cutter for packing materials as claimed in claim 1, wherein one end of the transverse rod is provided with a connecting rod, the connecting rod is connected to the sleeve, and the fixing member is inserted through the sleeve and screwed to the connecting rod.

5. The upright cutter for packing materials as claimed in claim 1, wherein the transverse rod has a length greater than that of the shaft.

6. The upright cutter for packing materials as claimed in claim 1, wherein the upright post is provided a limit member, the limit member has an accommodation portion, a switch knob, and a latch, the accommodation portion is formed with an opening, the latch is disposed in the accommodation portion, the switch knob is inserted through the opening and connected to the latch, the latch is movable along the accommodation portion to form a first position and a second position, when the latch is at the first position, the pole can be pivoted, when the latch is at the second position, the pole leans against the latch.

7. The upright cutter for packing materials as claimed in claim 1, wherein the shaft of the support device is sleeved with two tightening tubes, the shaft is threadedly connected with a first extension portion, the transverse rod is provided with a second extension portion corresponding to the first extension portion, and the second extension portion is axially formed with a dovetail groove.

8. The upright cutter for packing materials as claimed in claim 1, wherein the pole is provided with a fixing seat and a hook, the fixing seat is provided with a positioning member, the positioning member is connected with a positioning block, the positioning block is configured to clamp a measuring scale, and the hook is adapted for hanging a tape measure.

9. The upright cutter for packing materials as claimed in claim 1, wherein the pole is provided with a pivot member, one end of the pivot member is fixed to the upright post, and another end of the pivot member is connected to the pole.

* * * * *